US006677546B2

(12) United States Patent
Wei

(10) Patent No.: US 6,677,546 B2
(45) Date of Patent: Jan. 13, 2004

(54) INDUCTION CONTROL DEVICE FOR ACTIVATING SWITCHES

(76) Inventor: Jung-Tsung Wei, No. 176, Section 2, Tong-Man Road, Tainan City (TW)

( * ) Notice: Subject to any disclaimer, the term of this patent is extended or adjusted under 35 U.S.C. 154(b) by 0 days.

(21) Appl. No.: 10/226,271

(22) Filed: Aug. 23, 2002

(65) Prior Publication Data

US 2003/0042119 A1 Mar. 6, 2003

Related U.S. Application Data

(63) Continuation-in-part of application No. 09/946,350, filed on Sep. 6, 2001, now abandoned.

(51) Int. Cl.[7] ..... H01H 3/20
(52) U.S. Cl. ..... 200/331; 200/61.45 R
(58) Field of Search ..... 200/331, 334, 200/61.45 R, 51, 61.51; 73/570, 652, 654

(56) References Cited

U.S. PATENT DOCUMENTS 1,682,549 A * 8/1928 Billerbeck ..... 200/61.8
2,598,310 A * 5/1952 Schaser ..... 362/395
3,991,329 A * 11/1976 Iwasa et al. ..... 307/116
4,198,721 A * 4/1980 Copeland ..... 15/50.1
4,291,212 A * 9/1981 Bui ..... 200/331
4,293,006 A * 10/1981 Peter ..... 139/102
4,558,261 A * 12/1985 Cheng ..... 315/209 R
4,567,337 A * 1/1986 Woods et al. ..... 200/331
5,878,871 A * 3/1999 Miesner ..... 200/331
5,951,074 A * 9/1999 Guzzi et al. ..... 294/19.1
5,993,159 A * 11/1999 Mack ..... 416/146 R
6,242,704 B1 * 6/2001 Ambrose et al. ..... 200/331
6,295,871 B1 * 10/2001 Wei ..... 73/570

* cited by examiner

*Primary Examiner*—Elvin Enad
*Assistant Examiner*—Lisa Klaus
(74) *Attorney, Agent, or Firm*—Alan Kamrath; Rider Bennett, LLP

(57) ABSTRACT

A control device for activating an electric appliance includes a conductive thread connected to and hanged on an induction control switch. An end piece which is a conductive member is connected to the conductive thread. A wire with a plug extends from a first end of the induction control switch so as to be plugged in a plug on a wall, and an electrical appliance is connected to a second end of the induction control switch. The electric appliance is activated by petting the conductive thread or the end piece.

2 Claims, 8 Drawing Sheets

INDUCTION CONTROL DEVICE FOR ACTIVATING SWITCHES

The application is a Continuation-In-Part application of U.S. patent application Ser. No. 09/946,350 with the title of "STATIC INDUCTION DEVICE FOR ACTIVATING SWITCHES" to Jung-Tsung Wei, filed Sep. 6, 2001 now abandoned.

BACKGROUND OF THE INVENTION

FIELD OF THE INVENTION

A conventional switch for operation of a ceiling fan or a ceiling light is shown in FIG. 1 and generally includes a thread 1 connected to a switch in the ceiling fan or the ceiling light and a stop 11 is connected to a free end of the thread 1. When in operation, the user's hand has to hold the thread 1 or the stop 11 as shown in FIG. 2 and pulls the thread 1 to activate the switch as shown in FIG. 3. The number of the time that the thread 1 is pulled functions the switch to perform different actions. After the switch is activated, the thread 1 is released as shown in FIG. 4. It is difficult to catch the thread 1 in a dark room and the thread 1 has to be pulled vertically so as to precisely operate the switch. If the thread 1 is pulled at an angle relative to a vertical plain, the switch could not be operated. Besides, the thread 1 could bounce up if the thread 1 is released suddenly and is tangled by the rotating fan blades or the light.

U.S. Pat. No. 6,295,871 discloses a vibration sensing device which is mainly used for an alarm system which is activated by vibration to separate the two balls in the spherical shell. One of the balls is connected to a thread and the other ball sits on an inside of the spherical shell. Due to he gravity, the ball always sits on the inside of the spherical shell and the other ball contacts the ball on the inside of the shell normally, when a vibration happens, the two balls are separated because the spherical shell moves to activate the alarm system.

The present invention intends to provide an induction control device hanged from to a switch which is activated simply by touching the induction control device. The present invention provides a thread that is hung on an induction control switch and can be activated by petting or touching it.

SUMMARY OF THE INVENTION

In accordance with one aspect of the present invention, there is provided a control device for activating an electric appliance and the device comprises a conductive thread connected to and hanged on an induction control switch to which a wire with a plug extends and an electrical appliance is connected to the other end of the induction control switch. An end piece is connected to the conductive thread so that when a user pets the conductive thread or the conductive end piece, the switch is activated to operate the electrical appliance.

The primary object of the present invention is to provide an induction control device that activates a switch by touching the conductive thread of the device.

The present invention will become more obvious from the following description when taken in connection with the accompanying drawings which show, for purposes of illustration only, three preferred embodiments in accordance with the present invention.

DETAILED DESCRIPTION OF THE PREFERRED EMBODIMENTS

Figure 1:
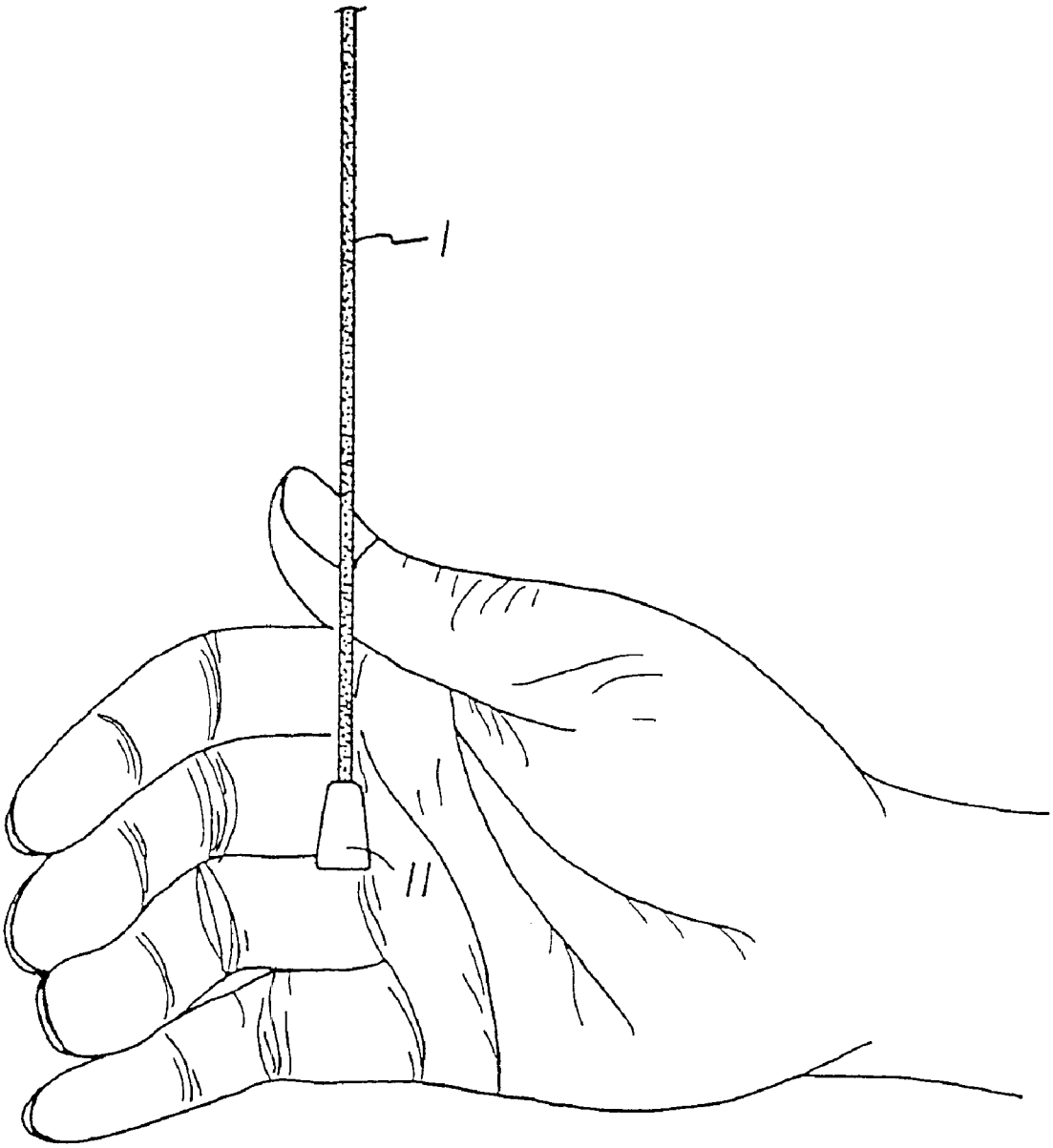
FIG.1 PRIOR ART
FIGS. 1 to 4 show four individual actions for operating a conventional pull type switch.
Figure 2:
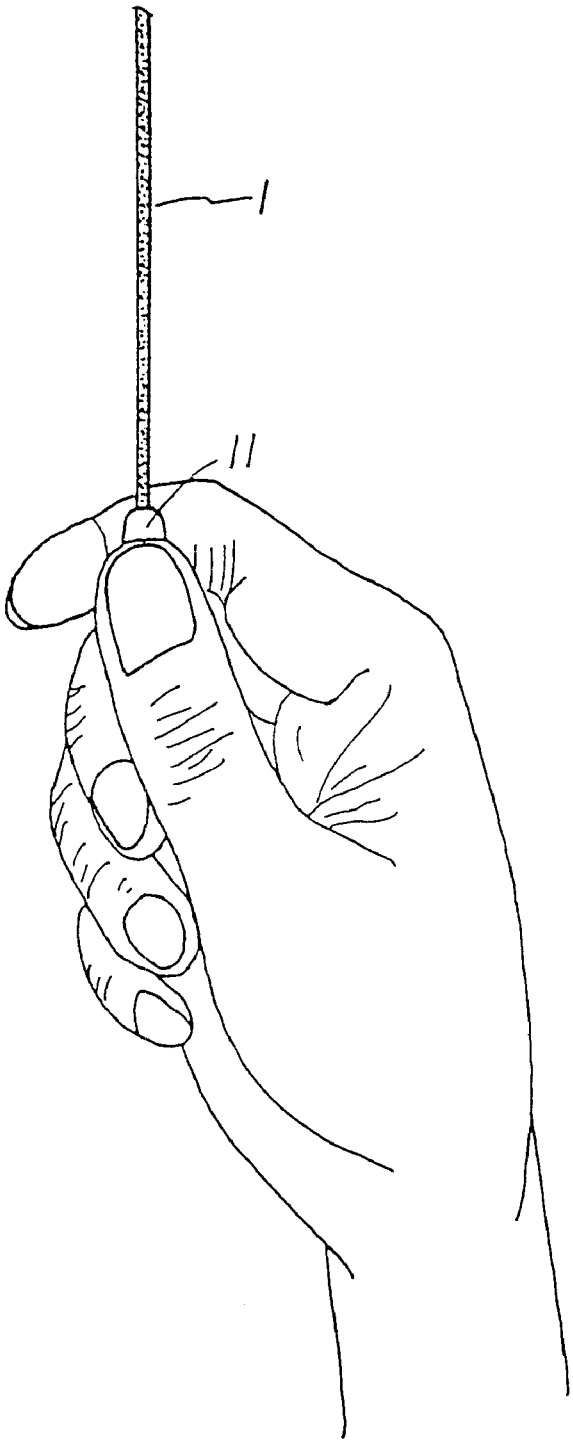
FIG.2 PRIOR ART
Figure 3:
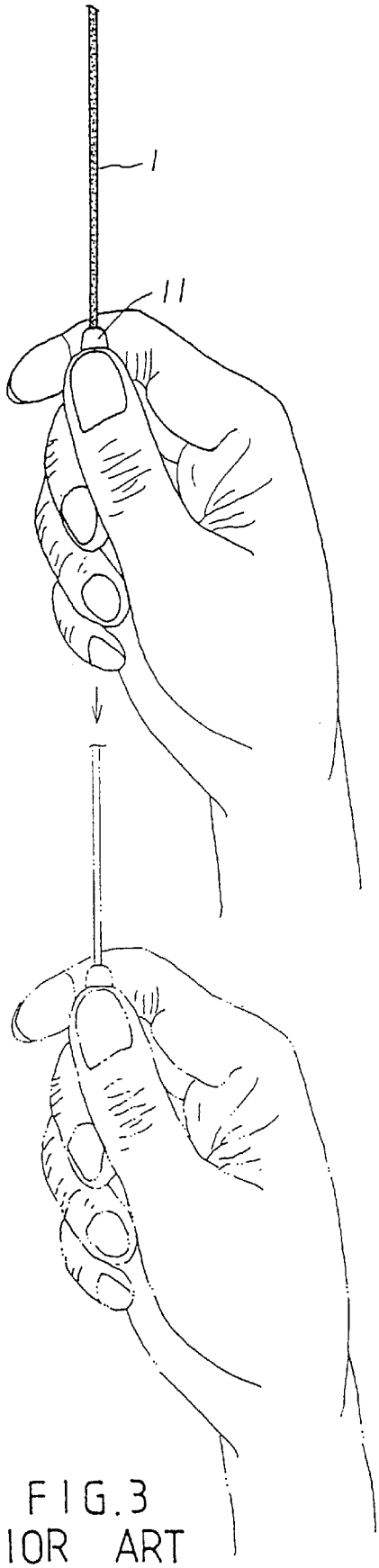
FIG.3 PRIOR ART
Figure 4:
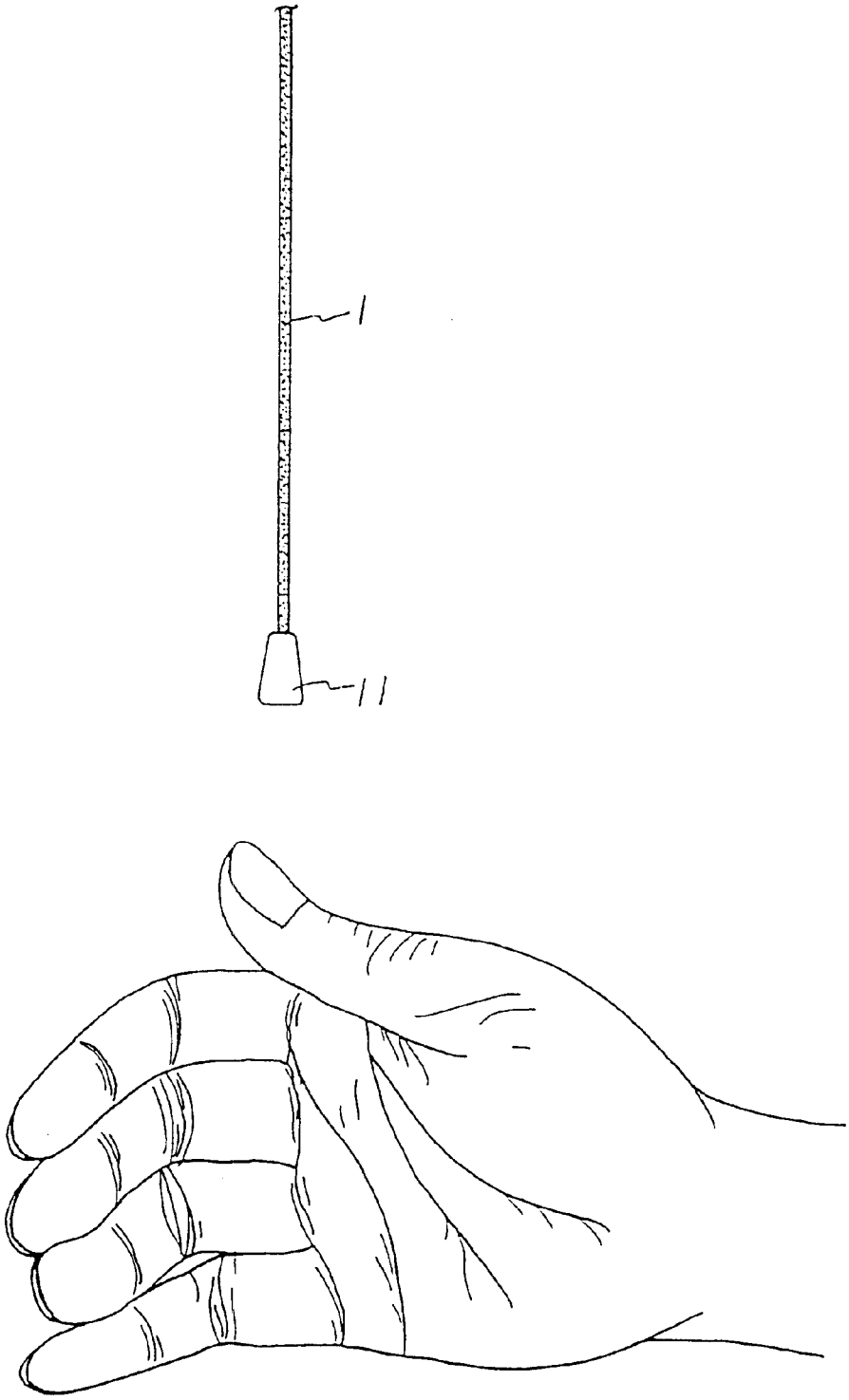
FIG. 4 PRIOR ART
Figure 5:
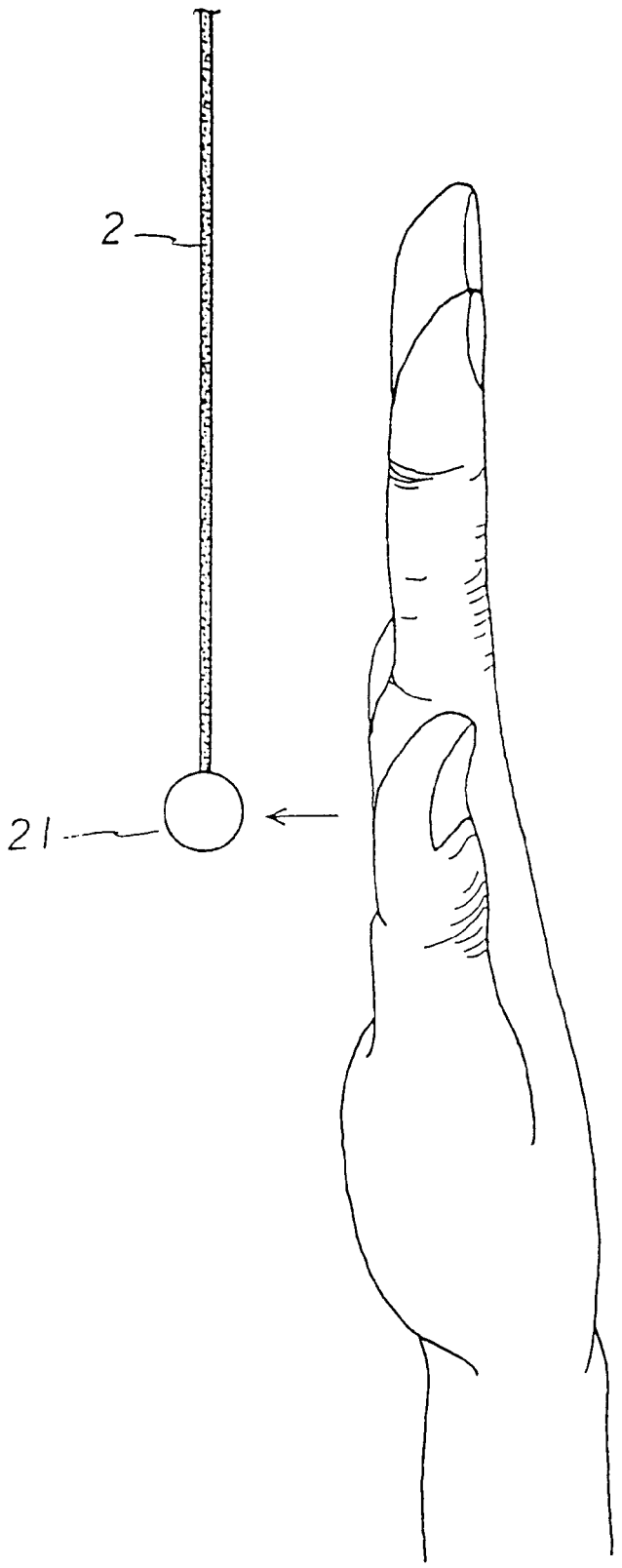
FIG. 5 is an illustrative view to show a user's hand approaches the static induction device of the present invention.
Figure 6:
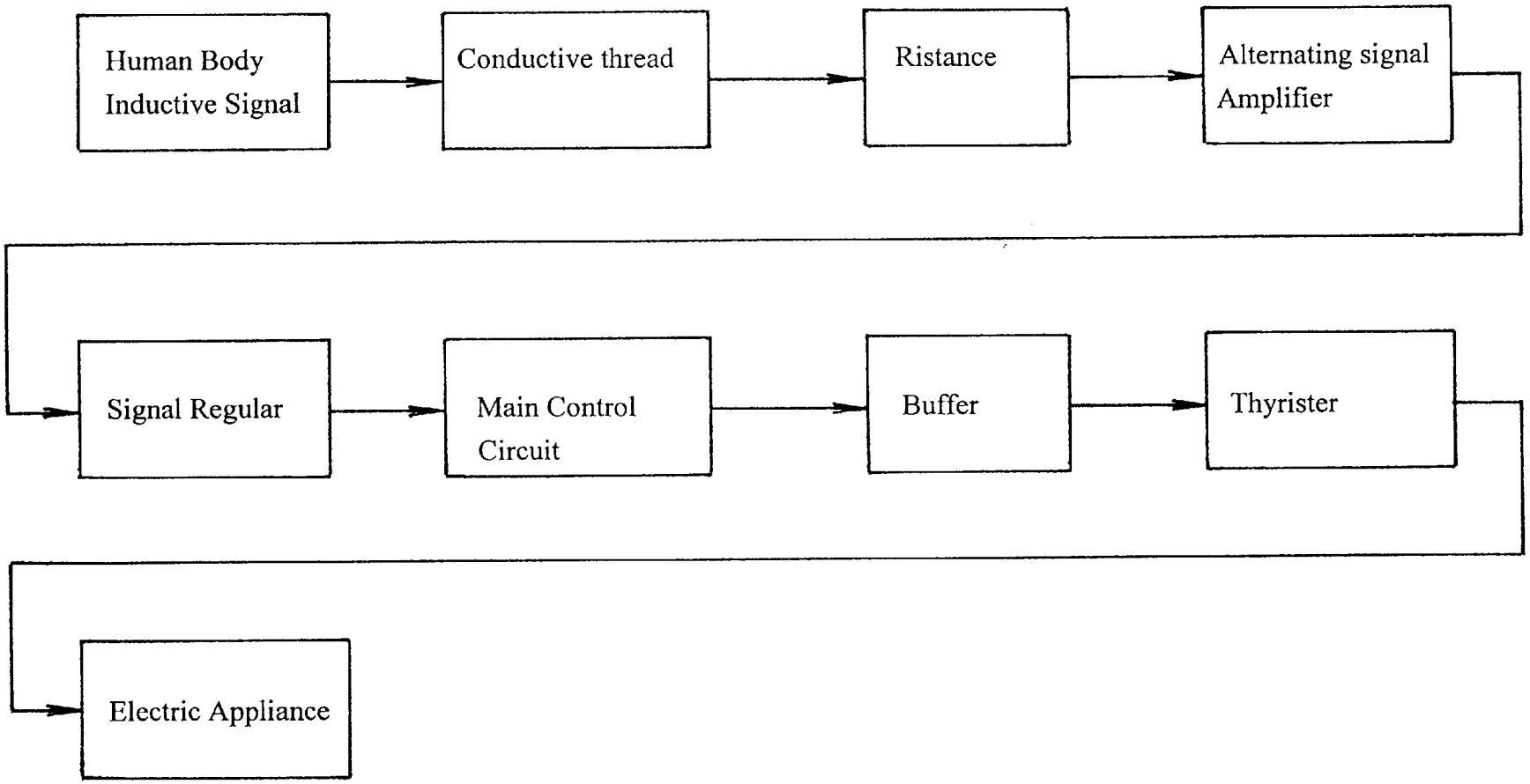
FIG. 6 shows an example of a circuit of the device and the electric appliance.

Referring to FIGS. 5 and 6, the induction device of the present invention comprises a conductive thread 2 with a conductive end piece 21 connected to a first end thereof and the other end of the conductive thread 2 is connected to an induction control switch. The switch includes a resistance connected to an alternating signal amplifier which is connected to a signal regulator. The signal regulator is connected to a main control circuit which is connected to a buffer connected to a Thyrister. An electric appliance such as a bulb or a fan is connected to the Thyrister. When the user pets the conductive thread 2 or the end piece 21, a human body inductive signal is input and activates the main control circuit to activate the bulb or the fan.

It is to be noted that the conductive thread 2 hanged on a control switch so that the user needs not to pull the conductive thread 2, he or she simply pets or touches the conductive thread 2 to activate the induction control switch and the bulb or the fan. This is convenient for the user to activate an electric appliance.

Figure 7:
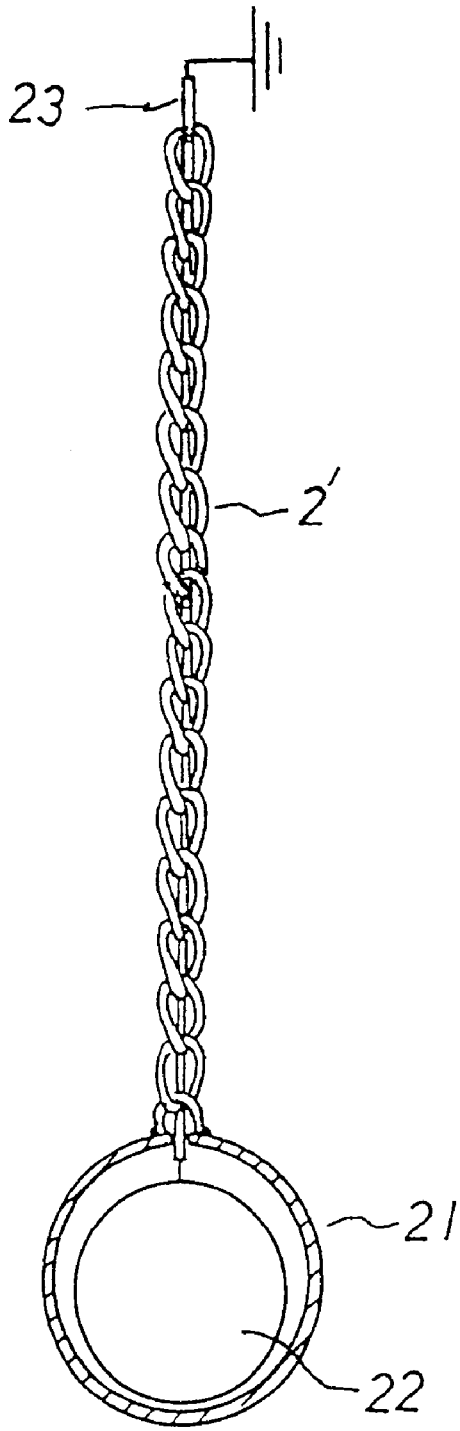
FIG. 7 shows another embodiment of the device of the present invention.
Figure 8:
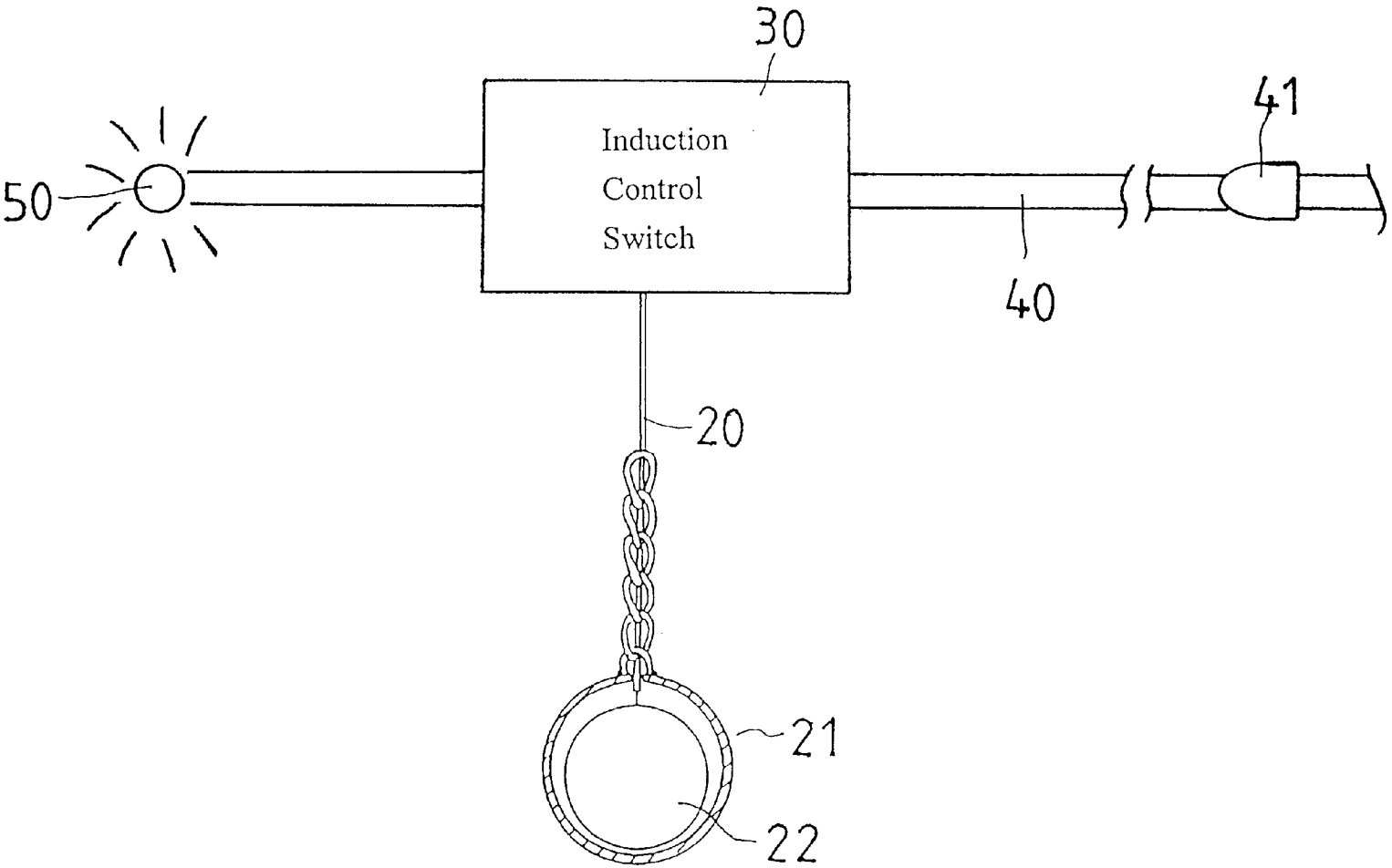
FIG. 8 shows the device as shown in FIG. 7 is connected with an electric appliance and a induction control switch.

FIGS. 7 and 8 show another embodiment of the present invention, wherein the conductive thread 20 is connected to and hanged on an induction control switch 30 and an end piece 21 which is a conductive hollow case is connected to the conductive thread 20. A wire 40 with a plug 41 extend from a first end of the induction control switch 30 and an electrical appliance 50 such as a bulb or a fan is connected to a second end of the induction control switch 30.

An outer layer 2' which is a conductive member is mounted to the conductive thread 20 and a touch member 22 is received in the hollow case. The touch member 22 is connected to an earth line 23 and hung in the hollow case with a gap between an inside of the hollow case and the touch member 22. The bulb or the fan can be activated by petting or touching the outer layer 2' or the hollow case 21 which is swung to contact the touch member 22 to activate the electric appliance 50.

While we have shown and described the embodiments in accordance with the present invention, it should be clear to those skilled in the art that further embodiments may be made without departing from the scope of the present invention.

What is claimed is:

1. A control device for activating an electric appliance, comprising:

a conductive thread connected to and hung on an induction control switch, an end piece connected to the conductive thread, a wire extending from a first end of the induction control switch and a plug connected to the wire, an electrical appliance connected to a second end of the induction control switch, an outer layer mounted on the conductive thread, a touch member received and hung in the end piece and connected to an earth line, and a gap defined between the touch member and an inside of the end piece.

2. The device as claimed in claim 1, wherein the end piece is a conductive member.

* * * * *